US009383114B2

(12) United States Patent
Takahara et al.

(10) Patent No.: US 9,383,114 B2
(45) Date of Patent: Jul. 5, 2016

(54) INDOOR EQUIPMENT OF AIR-CONDITIONER

(75) Inventors: Hideki Takahara, Chiyoda-ku (JP); Takashi Matsumoto, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 409 days.

(21) Appl. No.: 13/433,784

(22) Filed: Mar. 29, 2012

(65) Prior Publication Data

US 2012/0252346 A1 Oct. 4, 2012

(30) Foreign Application Priority Data

Mar. 29, 2011 (JP) ..... 2011-072333

(51) Int. Cl.

| | |
|---|---|
| ***F24F 7/007*** | (2006.01) |
| ***F24F 1/00*** | (2011.01) |
| *F24F 11/00* | (2006.01) |
| *F24F 13/20* | (2006.01) |

(52) U.S. Cl.

CPC ..... *F24F 1/0007* (2013.01); *F24F 1/0018* (2013.01); *F24F 11/0009* (2013.01); *F24F 2013/207* (2013.01)

(58) Field of Classification Search

CPC ... F24F 1/00007; F24F 1/0009; F24F 1/0018; F24F 2013/207

USPC ..... 454/228, 234, 235, 236, 237, 241, 249, 454/251, 252, 253, 271, 273, 329, 338, 341, 454/350

See application file for complete search history.

(56) References Cited

U.S. PATENT DOCUMENTS

| | | | | |
|---|---|---|---|---|
| 7,456,533 | B2 * | 11/2008 | Nanbu et al. | 310/71 |
| 7,643,296 | B2 * | 1/2010 | Yamada et al. | 361/704 |
| 2004/0060314 | A1 | 4/2004 | Gunji et al. | |

(Continued)

FOREIGN PATENT DOCUMENTS

| | | |
|---|---|---|
| CN | 1497228 A | 5/2004 |
| CN | 1572025 A | 1/2005 |

(Continued)

OTHER PUBLICATIONS

Masami et al., English Machine Translation of JP2009222327, Oct. 2009.*

Itagaki et al., English Machine Translation of WO2008/146555, Dec. 2008.*

(Continued)

*Primary Examiner* — Gregory Huson
*Assistant Examiner* — Dana Tighe
(74) *Attorney, Agent, or Firm* — Buchanan Ingersoll & Rooney PC

(57) ABSTRACT

An indoor equipment of an air-conditioner, the indoor equipment comprising: a casing including an inlet and an outlet, the casing including therein, a heat exchanger, an indoor fan which sends indoor air sucked from the inlet to the outlet through the heat exchanger, an indoor fan motor which drives the indoor fan, the indoor fan motor including a rotor of the motor and a stator having an electric winding, and an electric component box which accommodates a circuit board controlling the indoor fan motor, wherein an inverter circuit controlling a current flowing through the stator is mounted on the circuit board which is accommodated in the electric component box, and wherein at least one element among switching elements and diode elements which configure the inverter circuit is formed of wide bandgap semiconductor.

9 Claims, 5 Drawing Sheets

(56) References Cited

U.S. PATENT DOCUMENTS

| | | | | |
|---|---|---|---|---|
| 2004/0248330 | A1 | 12/2004 | Kitabatake et al. | |
| 2006/0186746 | A1 | 8/2006 | Nanbu et al. | |
| 2008/0123373 | A1* | 5/2008 | Roesner et al. | 363/65 |
| 2009/0256440 | A1* | 10/2009 | Kragh et al. | 310/89 |
| 2010/0033885 | A1* | 2/2010 | Hotchkiss et al. | 361/56 |
| 2010/0101889 | A1* | 4/2010 | Yamaguchi | B62D 5/0406 180/444 |
| 2010/0283514 | A1* | 11/2010 | Soeno et al. | 327/109 |

FOREIGN PATENT DOCUMENTS

| | | | |
|---|---|---|---|
| CN | 201064020 | Y | 5/2008 |
| CN | 101432577 | A | 5/2009 |
| JP | 6325461 | A | 7/1988 |
| JP | 2003219687 | A | 7/2003 |
| JP | A-2008-61414 | | 3/2008 |
| JP | 2008526175 | A | 7/2008 |
| JP | 2008-187798 | A | 8/2008 |
| JP | 2009222327 | A | 10/2009 |
| WO | 2007132889 | A1 | 11/2007 |
| WO | 2008146555 | A1 | 12/2008 |

OTHER PUBLICATIONS

Office Action issued on Dec. 18, 2013, by the Chinese Patent Office in corresponding Chinese Patent Application No. 2012100941398, and an English Translation of the Office Action. (9 pages).

Office Action (Notification of Reasons for Refusal) issued on Feb. 12, 2014, by the Japanese Patent Office in corresponding Japanese Patent Application No. 2011-072333, and an English Translation of the Office Action. (13 pages).

Takahisa Endo et al., Energy-Saving Technologies for Advanced Air-Conditioner Inverter System Toshiba Review, Toshiba Corporation vol. 61, No. 12, pp. 47-50 (2006).

Aug. 26, 2014 Japanese Office Action issued in Japanese Patent Application No. 2011-072333 (with English language translation).

Jul. 28, 2014 Australian Office Action issued in Australian Patent Application No. 2012201818.

May 12, 2014 Chinese Office Action issued in Chinese Patent Application No. 201210094139.8 (with English language translation).

Office Action issued on Sep. 10, 2014, by the Chinese Patent Office in corresponding Chinese Patent Application No. 201210094139.8 and an English translation of the Office Action. (9 pages).

* cited by examiner

INDOOR EQUIPMENT OF AIR-CONDITIONER

CROSS-REFERENCE TO RELATED APPLICATIONS

This application claims priority from Japanese Patent Application No. 2011-072333 filed on Mar. 29, 2011, the entire contents of which are incorporated herein by reference.

TECHNICAL FIELD

Aspects of the invention relate to an indoor equipment of an air-conditioner which includes an indoor fan and a fan motor which drives the indoor fan to rotate.

BACKGROUND

A related-art indoor equipment of an air-conditioner includes a line flow fan as an indoor fan, and the conditioning of room air is performed when the line flow fan is driven by a fan motor to rotate. Specifically, after an air flow sucked from an inlet of the main body of the indoor equipment is conditioned by a heat exchanger which is mounted inside the indoor equipment, the conditioned air flow is blown out from an outlet of the main body of the indoor equipment to an indoor space. A rotating mechanism such as a stator and a rotor and a control board, on which an inverter circuit that control the rotation of the motor is mounted, is installed in the fan motor (for example, refer to JP-A-2008-187798).

SUMMARY

Because the fan motor, which accommodates the control board which includes the inverter circuit inside a housing thereof, is used in the related-art indoor equipment of the air-conditioner, the control board and the rotating mechanism of the fan motor are arranged closely inside the housing. Therefore, there is a problem that electrical pitting tends to occur in the rotating mechanism of the fan motor due to electromagnetic noise which is generated when switching elements of the inverter circuit perform high speed switching actions. Here, the electrical pitting is a phenomenon in which an inside of a bearing of the fan motor is damaged and abnormal sound is generated when a voltage is applied to the bearing and electric discharge is repeated.

Further, because the switching elements of the inverter circuit are made of Si (silicon) semiconductor, a large amount of heat is produced from the switching elements by the high speed switching actions. In order to cool the switching elements, for example, a heat sink is mounted, or the whole fan motor is sealed with a mold which is formed of a member having high heat resistance. When the heat sink is mounted, it becomes hard to downsize the fan motor, and the heat sink becomes a main factor of increasing the size of the indoor equipment. Further, when the mold which is formed of a member having high heat resistance is used, there is a problem that cost required for the mold increases.

Further, the relater-art indoor equipment of the air-conditioner has not only the fan motor which accommodates the control board therein, but also an electric component box inside which an electronic control board which controls the whole air-conditioner is provided. Therefore, the boards which are related to electronic controls are separately arranged in two places, that is, inside the fan motor and inside the electric component box. Therefore, since there are multiple places which could become an ignition source of the electronic components, there is a problem that cost for safety measures increases.

Even if all the electronic control boards are accommodated in the electric component box, because the electric component is configured such that the electric component box is almost sealed to prevent spread of a fire, it is not possible to exhaust heat adequately. Thus, there arises a problem that elements, which become a high temperature when the elements are operated or can not operate normally in a high temperature, can not be mounted.

The invention is accomplished to solve the problems as described above. The first object of the present invention is to obtain an indoor equipment of an air-conditioner which includes a fan motor for which an electrical pitting phenomenon is unlikely to occur. The second object of the present invention is to realize downsizing of a fan motor, and downsizing of a body of an indoor equipment. The third object of the present invention is to obtain an indoor equipment of an air-conditioner that requires less cost for taking safety measures.

According to an aspect of the invention, there is provided an indoor equipment of an air-conditioner, the indoor equipment comprising: a casing including an inlet and an outlet, the casing including therein, a heat exchanger, an indoor fan which sends indoor air sucked from the inlet to the outlet through the heat exchanger, an indoor fan motor which drives the indoor fan, the indoor fan motor including a rotor of the motor and a stator having an electric winding, and an electric component box which accommodates a circuit board controlling the indoor fan motor, wherein an inverter circuit controlling a current flowing through the stator is mounted on the circuit board which is accommodated in the electric component box, and wherein at least one element among switching elements and diode elements which configure the inverter circuit is formed of wide bandgap semiconductor.

Because the indoor equipment of the air-conditioner of an aspect of the present invention is configured so that the inverter circuit for driving the indoor fan motor is provided in the electric component box, it is possible to suppress occurrence of the electrical pitting to the indoor fan motor. Since the circuit board on which the inverter circuit for driving the indoor fan motor is mounted is not mounted inside the indoor fan motor, the downsizing of the fan motor can be realized. Because electronic components are accommodated only in the electric component box, it is possible to take safety measures at a low cost.

DETAILED DESCRIPTION

First Exemplary Embodiment

Figure 1:
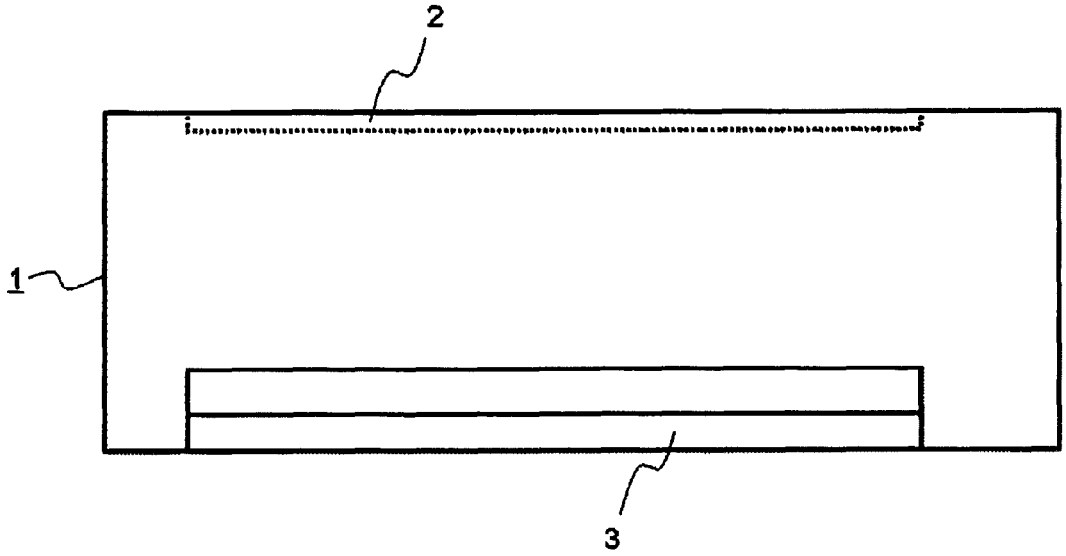
FIG. 1 is a front view of an external form of an indoor equipment of an air-conditioner in a first exemplary embodiment.

Structures and operations of an indoor equipment of an air-conditioner in the first exemplary embodiment are described based on the figures. A front view of the external form of the indoor equipment of an air-conditioner is shown in FIG. 1. The indoor equipment shown in FIG. 1 has an inlet 2 which sucks indoor air and the inlet 2 is provided at an upper part of a casing 1 of the indoor equipment. Because it is hard to see the inlet 2 from the front side of the indoor equipment, the inlet 2 is shown by dotted lines. An outlet 3, which can be opened and closed to blow out the air flow which has been heat exchanged inside the indoor equipment, is provided at a lower part of the casing 1 of the indoor equipment.

Figure 2:
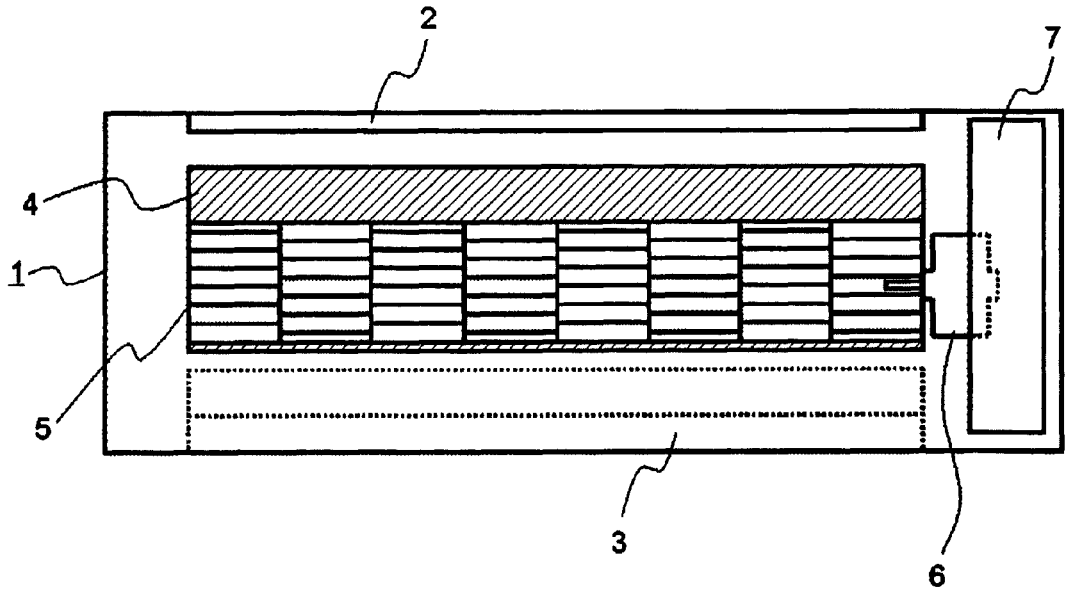
FIG. 2 shows an internal structure of the indoor equipment of an air-conditioner in the first exemplary embodiment.

FIG. 2 shows an internal structure of the casing 1 of the indoor equipment. In the indoor equipment 1, there are a heat exchanger 4, a line flow fan 5, an indoor fan motor 6 and an electric component box 7. The heat exchanger 4 performs heat exchange between the air flow which is sucked from the inlet 2 and a refrigerant. The line flow fan 5 generates a flow of air so that the indoor air is sucked from the inlet 2 and the sucked air contacts the heat exchanger 4. The indoor fan motor 6 rotates the line flow fan 5. Electric components, which perform drive control of the indoor fan motor 6, control of wind velocity or wind direction of the air flow which is blown out from the outlet 3 and control of power supply to an outdoor equipment (not shown in the figure) or signal transmission to the outdoor equipment, are provided inside the electric component box 7.

Figure 3:
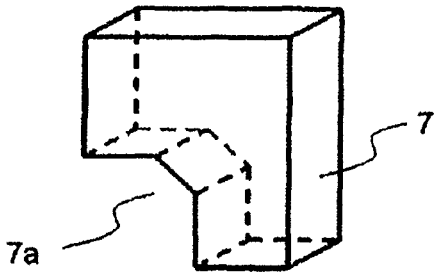
FIG. 3 shows an external form of an electric component box in the first exemplary embodiment.

FIG. 3 shows an external form of the electric component box 7. The electric component box 7 has a housing having a shape such that a recess 7*a* is provided at a part of a substantially cuboid shape. The indoor fan motor 6 is adapted to be incorporated in the recess 7*a*. The part of the indoor fan motor 6 that is incorporated in the recess 7*a* of the electric component box 7 is shown with dotted lines in FIG. 2.

Figure 4:
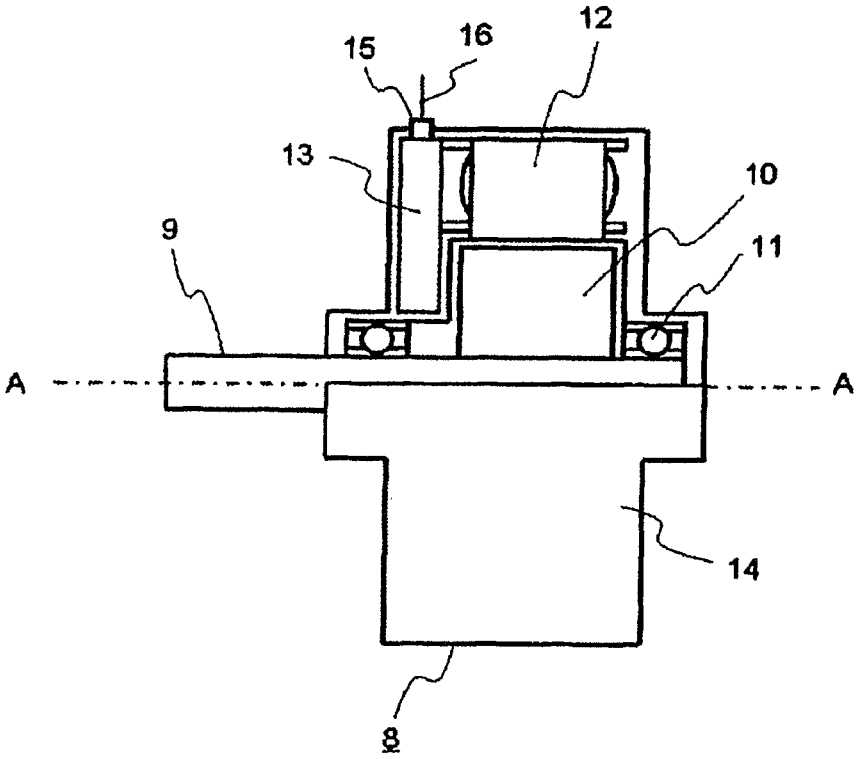
FIG. 4 BACKGROUND ART
FIG. 4 shows a structure of a related-art fan motor.

Before the indoor fan motor 6 is described, a structure of a related-art indoor fan motor is described first for comparison. FIG. 4 shows a structure of the related-art indoor fan motor 8. In FIG. 4, an upper half part above a central line A-A shows a sectional view inside the indoor fan motor 8. The related-art indoor fan motor 8 includes a shaft 9 which is the rotation axis of the motor, a rotor part 10 of the motor which is connected to the shaft 9, a bearing 11 which supports the shaft 9, a stator 12 which has an electric winding to produce force rotate the rotor part 10 of the motor, a circuit board 13 and a mold 14. Electronic components, which control the current flowing in the electric winding of the stator 12 to produce the power to rotate the rotor part 10 of the motor, are mounted on the circuit board 13. The mold 14 covers the whole motor to protect all components inside the motor from outside disturbances (environmental noise or the like), and is made of a material which can withstand heat from the mounted components of the circuit board 13. The electric component box 7 is connected to the circuit board 13 by a wire 16 through a connector 15.

Electronic components which an inverter circuit includes are mounted on the circuit board 13. The inverter circuit controls the current flowing through the stator 12 to control the indoor fan motor. The inverter circuit has switching elements such as transistors which are formed of semiconductor and diodes reversely connected in parallel with the switching elements, and drives the indoor fan motor 8 by generating a motor driving current. The structure of the inverter circuit will be described later. In the related-art indoor fan motor 8, Si semiconductor is used for the switching elements and the diodes.

Generally, the Si semiconductor elements produce a large amount of heat in switching, and have a characteristic that the elements are not able to normally operate when the temperature of the elements reaches a high temperature of around 100° C. Therefore, when the Si semiconductor elements are equipped on the circuit board, a means for dissipating the heat produced by the Si semiconductor elements is necessary. Fins for heat dissipation are usually attached to the Si semiconductor elements, and the heat from the semiconductor elements is further dissipated by exposing the fins for heat dissipation to air. In order to equip the Si semiconductor elements on the circuit board, a volume enough to equip the fins for heat dissipation and a space for heat dissipation through an air-cooling function become necessary.

In the related-art indoor fan motor 8, the heat produced by the electronic components mounted on the circuit board 13 is exhausted outside via the mold 14. Since the mold 14 is used instead of the heat dissipating fins, it is necessary for the mold 14 to be made of a material that can withstand the heat produced by the mounted components.

Further, it is possible that an electronic circuit such as the inverter circuit for driving the motor becomes an ignition source due to short-circuit of wiring. On the other hand, because electronic components for controlling the air-conditioner are also provided inside the electric component box 7, there are two places, that is, the indoor fan motor and the electric component box, in the related-art indoor equipment where measures against fire are required. Therefore, there is a problem that cost required for safety measures increases.

One way of gathering the boards which require countermeasure against fire in one place is to accommodate the circuit board 13 in the electric component box 7. However, in this case, it is necessary to provide a space for providing heat dissipating fins and a room for heat dissipation inside the electric component box 7. Further, in order to secure the flow of air to the heat dissipating fins, holes for ventilation have to be provided in the housing of the electric component box 7, but the fire safety of the electric component box would decrease.

When the circuit board is provided inside the related-art indoor fan motor, there is a problem that electrical pitting tends to occur. Here, the "electrical pitting" is a phenomenon in which the inner diameter of the bearing is damaged and abnormal sound is generated when a voltage is applied to the bearing 11 of the motor of the indoor fan motor 8 and electric discharge is repeated. The electrical pitting phenomenon tends to occur when the inverter circuit for driving the motor, which is a voltage source, is provided inside the motor and near the bearing 11 of the motor, such as the configuration of the indoor fan motor 8.

A frequency of the occurrence of the electrical pitting may be changed by the control method of the inverter circuit for driving. In a typical indoor fan motor, a 120 degree power supply method in which the electrical pitting is unlikely to be produced is often used as an inverter control method. However, in comparison with a sine wave drive method, in the 120 degree excitation method, because the signal waveform to rotate the motor is disrupted, motor efficiency decreases and the 120 degree excitation method may be a cause of noise and vibration.

Figure 5:
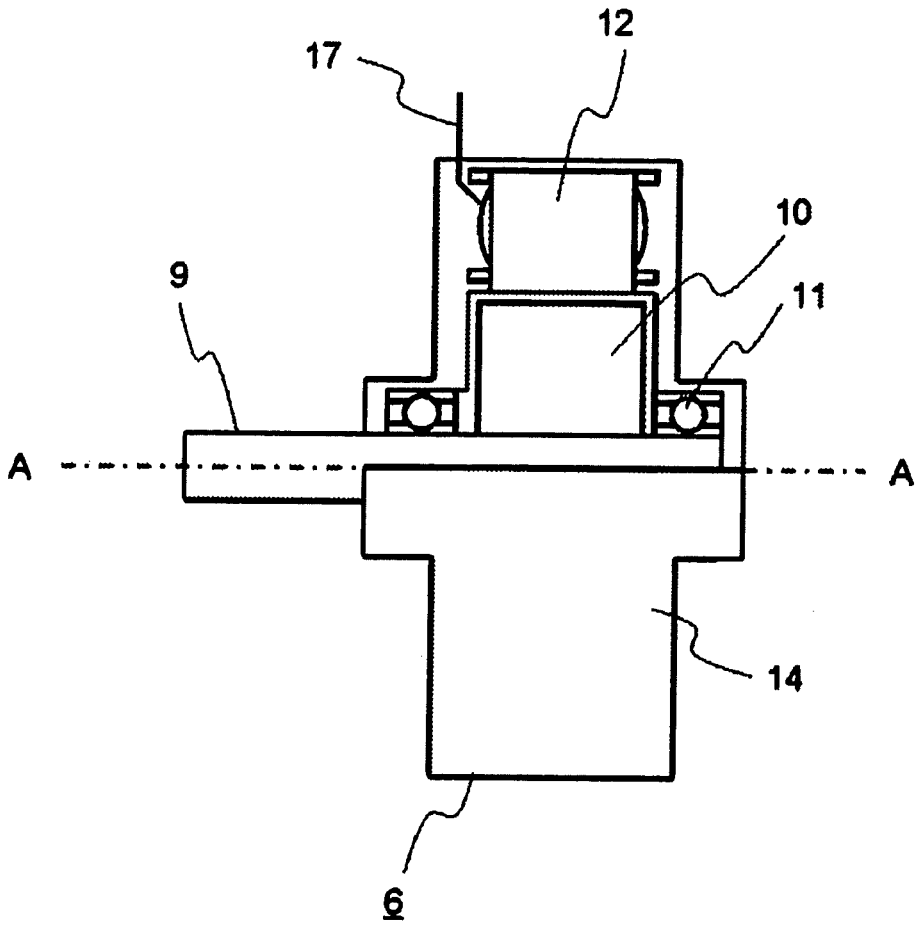
FIG. 5 shows a structure of a fan motor in the first exemplary embodiment.

Next, a structure of the indoor fan motor 6 in the present exemplary embodiment is described based on the figures. FIG. 5 shows the structure of the indoor fan motor 6 in the present exemplary embodiment. In FIG. 5, the same numbers and signs are provided to the same or corresponding components as those in FIG. 4. In FIG. 5, an upper half part above a central line A-A shows a sectional view inside the indoor fan motor 6. The indoor fan motor 6 includes a shaft 9 which is the rotation axis of the motor, a rotor part 10 of the motor which is connected to the shaft 9, a bearing 11 which supports the shaft 9, a stator 12 which has an electric winding to produce force to make the rotor part 10 of the motor to rotate, and a mold 14 which covers the whole motor to protect all components inside the motor from outside disturbances (environmental noise or the like). The stator 12 is connected to an inverter circuit provided inside an electric component box 7 to be described later through a wiring 17, and a motor driving current is supplied to the stator 12 through the wiring 17. The external form of the whole indoor fan motor 6 is downsized by removing the circuit board 13, which was in the related-art indoor fan motor 8, from the indoor fan motor 6.

Figure 6:
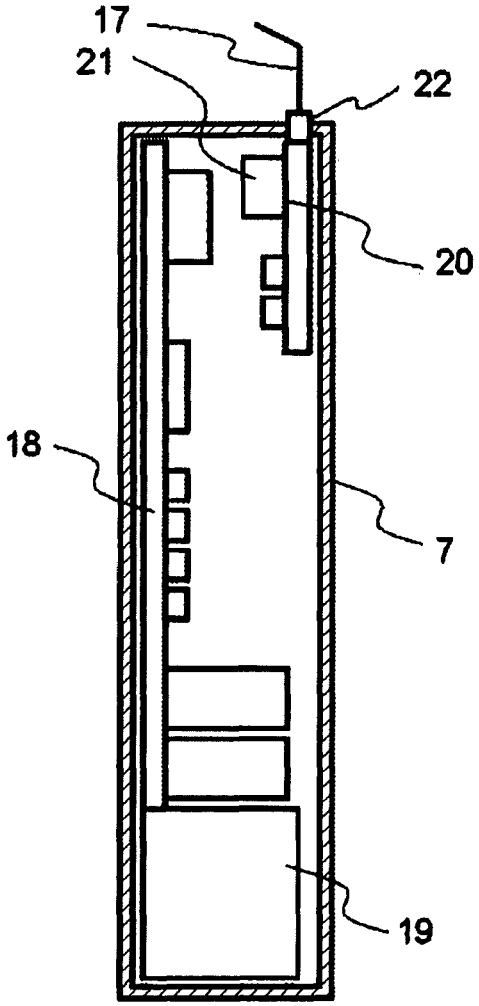
FIG. 6 shows a structure of the inside of the electric component box in the first exemplary embodiment.

Next, the internal structure of the electric component box 7 is described based on the figures. FIG. 6 shows the internal structure of the electric component box 7. The electric component box 7 is almost sealed with metal or a high flame-resistant material, and a circuit board 18 and a terminal block 19 are provided inside the electric component box 7. Electric components, which perform the control of the wind velocity or the wind direction of the air flow which is blown out from the outlet 3 of the indoor equipment and the control of the power supply to an outdoor equipment (not shown in the figure) or cooperative actions with the outdoor equipment, are mounted on the circuit board 18. Signal lines which link the indoor equipment 1 to the outdoor equipment are attached to the terminal block 19.

Further, a circuit board 20 is installed in the electric component box 7, and a semiconductor module 21 is mounted on the circuit board 20. Electronic components configuring an inverter circuit 23, which controls the current that flows through the electric winding of the stator 12, are provided inside the semiconductor module 21. A motor driving current which the semiconductor module 21 generates is output from the electric component box 7 from a connector 22 by a signal line 17, and is supplied to the stator 12 of the indoor fan motor 6. FIG. 6 shows that the connector 22 is directly connected to (i.e., touches) the circuit board 20.

A power source socket (not shown in the figure) is connected to the electric component box 7 with a power supply cable. The electric component box 7 operates by the electric power supplied from the power supply cable. Because the electric component box 7 is almost sealed with a metal or a high flame-resistant, even if an electric short occurs in the electronic components of the electric component box 7 and the electronic components catch a fire, the fire is prevented from spreading to the outside the electric component box 7.

Figure 7:
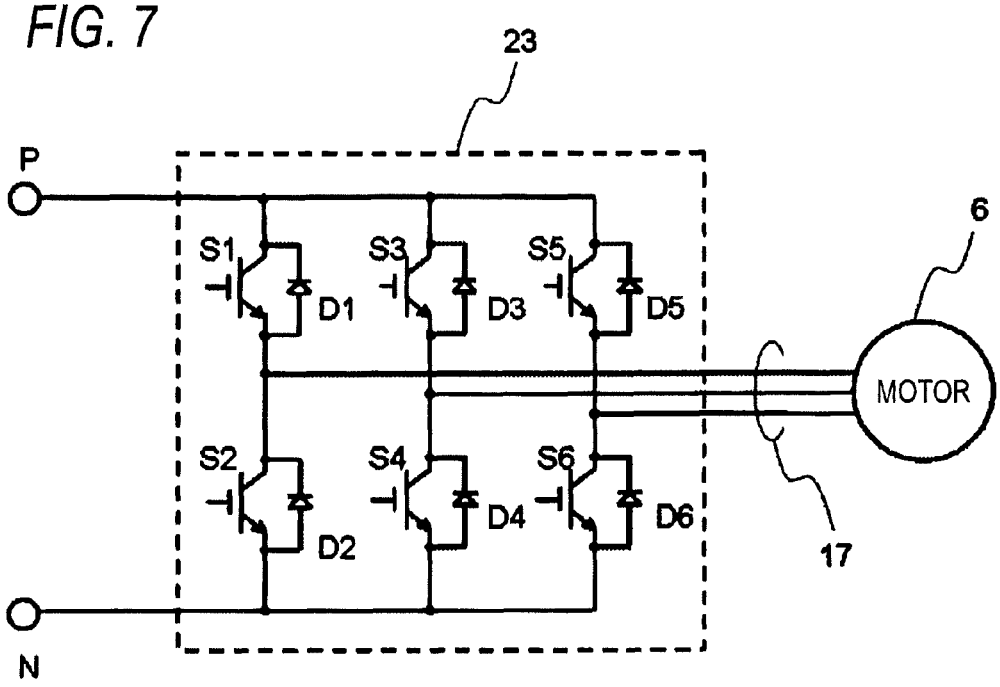
FIG. 7 shows a structure of an inverter circuit in the first exemplary embodiment.

A structure of the inverter circuit 23 which drives the indoor fan motor is shown in FIG. 7. The inverter circuit 23 has switching elements S1 to S6 such as transistors which are formed of semiconductor and diodes D1 to D6 reversely connected in parallel with the switching elements S1 to S6 respectively. The indoor fan motor 6 is driven when the inverter circuit 23 generates a motor driving current that flows through a signal line 17 from a DC voltage between bus terminals P and N by making the switching elements S1 to S6 operate to be alternately ON/OFF. Here, the switching elements S1 to S6 and the diodes D1 to D6 are formed of wide bandgap semiconductor. Because a circuit such as a control unit which generates the gate signals of the switch elements S1 to S6 is a well known technique, the circuit is not shown in FIG. 7. Further, the control method of the inverter circuit 23 for driving the indoor fan motor may be either of a control method with sensors or a sensorless control method.

The wide bandgap semiconductor includes SiC (silicon carbide), GaN (gallium nitride), diamond and the like. Because a wide bandgap semiconductor element has a smaller element loss than a Si semiconductor element, the amount of heat produced by the wide bandgap semiconductor element is smaller. Because the melting point of the wide bandgap semiconductor element is higher than that of the Si semiconductor element and is equal to or higher than 200° C., it is possible for the wide bandgap semiconductor element to operate at a high temperature. Further, because the thermal conductivity is also good, the wide bandgap semiconductor element can operate even if the fin for heat dissipation is not provided.

Because the electric component box 7 is almost sealed, the air flow is restricted and the convection of heat may not occur adequately. Therefore, the elements such as Si semiconductor elements which can not operate at a high temperature cannot be used as the elements of the inverter circuits. However, since it is possible for wide bandgap semiconductor elements to operate at a high temperature, it is possible to accommodate the wide bandgap semiconductor elements in the electric component box 7.

Because it is possible for the wide bandgap semiconductor elements to operate at a high temperature without heat dissipating fins, when the circuit board 20 on which the wide bandgap semiconductor elements are mounted is accommodated in the electric component box 7, it is not necessary to mount additional heat dissipating fins. Therefore, even if the circuit board 20 is installed inside the electric component box 7, the increase of the volume of the electric component box 7 is suppressed, and further, the circuit boards which may become an ignition source can be gathered and arranged inside the electric component box 7. As previously described, because the electric component box 7 is almost sealed with metal or a high flame-resistant material, the safety measures against fire can be taken effectively without incurring additional cost.

It is preferred to realize an almost sealed state by, for example, using a material having high flame-resistance as the connector 22 so that fire would not spread from the part where the connector 22 is used, or by making the connector 22 as small as possible.

In the above description, it is assumed that all of the switching elements and the diode elements configuring the inverter circuit are formed of the wide bandgap semiconductor. However, the invention is not limited thereto. It is also possible that at least one element among the switching elements or the diode elements is formed of the wide bandgap semiconductor.

Further, although the configuration in which the fins for heat dissipation are not provided has been described, a small heat dissipating fin may be used accessorily.

Further, in the above description, the circuit board 20 is installed separately from the circuit board 18 of the indoor equipment. However, since the inverter circuit can be downsized by using the wide bandgap semiconductor, when there is a space above the circuit board 18 of the indoor equipment, the semiconductor module 21, in which the electronic components configuring the inverter circuit 23 for the indoor fan motors are provided, may be mounted on the circuit board 18.

Further, the inverter circuit 23 may not be a modulated semiconductor circuit. Single-function elements such as a switching element or a diode may be arranged instead.

As described above, in the first exemplary embodiment, because the circuit board can be removed from the indoor fan motor 6, it is possible to lower the flame-resistance level of the material of the mold 14 which covers the indoor fan motor 6, and a cost saving effect can be expected.

Further, because the indoor fan motor 6 can be made thinner, the width of the line flow fan 5 and the heat exchanger 4 can be extended, and the air conditioning performance of the air-conditioner can be improved.

Further, because the inverter circuit is not mounted inside the indoor fan motor 6, it is unlikely that the electrical pitting occurs to the indoor fan motor. Further, because the voltage source for driving the motor can be kept away from the location of the indoor fan motor 6, tolerance against the electrical pitting can be increased. Therefore, not only the 120 degree excitation method but also the sine wave drive method can be used. As a result, the waveforms for rotating the motor rotate can be a sine wave, and the rotation of the motor becomes smooth. Thus, the noise and the vibration can be reduced, and the motor efficiency can be improved.

Further, by using the wide bandgap semiconductor in the inverter circuit for driving the indoor fan motor, the inverter circuit for driving the indoor fan motor is not provided inside the fan motor but arranged inside the electric component box of the indoor equipment. Therefore, the fire sources can be gathered in one place, and the safety measures against fire can be taken effectively.

Second Exemplary Embodiment

In the first exemplary embodiment, when the circuit board, on which the inverter circuit for driving the indoor fan motor is mounted, is accommodated in the electric component box, an surface of the board, on which the semiconductor module including the inverter circuit is mounted, is arranged to be opposite to the housing of the electric component box. In the second exemplary embodiment, the circuit board is arranged so that the surface of the module including the inverter circuit contacts with the housing of the electric component box directly.

Figure 8:
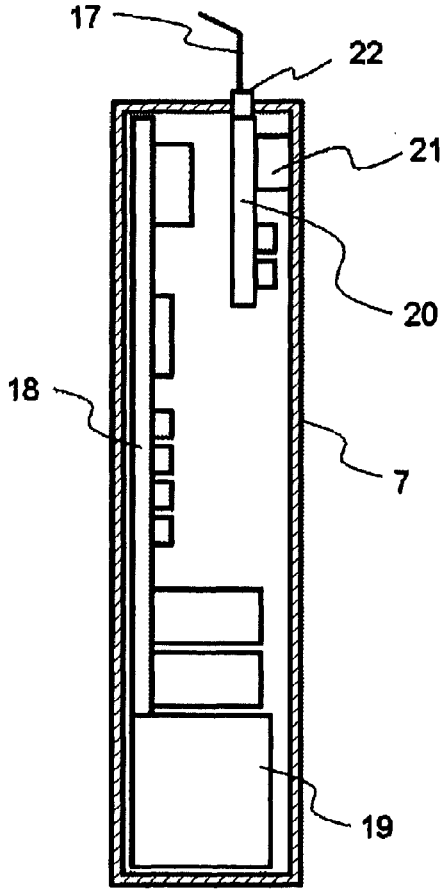
FIG. 8 shows a structure of the inside of an electric component box in a second exemplary embodiment.

Hereinafter, the description is based on FIG. 8. FIG. 8 is a figure which shows the internal structure of the electric component box 7 of the present exemplary embodiment. In FIG. 8, the same numbers and signs are provided to the same or corresponding components as those in FIG. 6. Similarly to the electric component box in the first exemplary embodiment, a circuit board 18, a terminal block 19, and a circuit board 20 are installed inside an electric component box 7. A semiconductor module 21, in which an inverter circuit which controls the indoor fan motor is accommodated, is mounted on the circuit board 20. In the second exemplary embodiment, the circuit board 20 is arranged so that the surface of the semiconductor element module 21 contacts with the housing of the electric component box 7 directly.

The electric component box 7 is almost surrounded by the housing which is manufactured by metal or high flame-resistant materials to increase the air tightness. Since the heat from the semiconductor module 21 is directly dissipated through the housing, the heat dissipation of the semiconductor module 21 can be implemented effectively. In this way, because it is not necessary to secure space for heat dissipating courses separately inside the electric component box 7, the arrangement space in the electric component box 7 can be utilized effectively.

The present invention provides illustrative, non-limiting aspects as follows:

(1) In a first aspect, there is provided an indoor equipment of an air-conditioner, the indoor equipment comprising: a casing including an inlet and an outlet, the casing including therein, a heat exchanger, an indoor fan which sends indoor air sucked from the inlet to the outlet through the heat exchanger, an indoor fan motor which drives the indoor fan, the indoor fan motor including a rotor of the motor and a stator having an electric winding, and an electric component box which accommodates a circuit board controlling the indoor fan motor, wherein an inverter circuit controlling a current flowing through the stator is mounted on the circuit board which is accommodated in the electric component box, and wherein at least one element among switching elements and diode elements which configure the inverter circuit is formed of wide bandgap semiconductor.

(2) In a second aspect, there is provided the indoor equipment of an air-conditioner according to the first aspect, wherein the inverter circuit is mounted on the circuit board as a semiconductor module.

(3) In a third aspect, there is provided the indoor equipment of an air-conditioner according to the first aspect, wherein the circuit board is arranged so that a surface of a component which the inverter circuit includes contacts a housing of the electric component box directly.

(4) In a fourth aspect, there is provided the indoor equipment of an air-conditioner according to the second aspect, wherein the circuit board is arranged so that a surface of the semiconductor module contacts with a housing of the electric component box directly.

(5) In a fifth aspect, there is provided the indoor equipment of an air-conditioner according to any one of the first to fourth aspects, wherein all of the switching elements and diode elements which configure the inverter circuit are formed of wide bandgap semiconductor.

(6) In a sixth aspect, there is provided the indoor equipment of an air-conditioner according to any one of the first to fifth aspects, wherein at least the stator of the indoor fan motor is covered with a mold.

(7) In a seventh aspect, there is provided the indoor equipment of an air-conditioner according to any one of the first to sixth aspects, wherein the inverter circuit of the indoor fan motor is driven by sine waves.

(8) In an eighth aspect, there is provided the indoor equipment of an air-conditioner according to any one of the first to seventh aspects, wherein the wide bandgap semiconductor is silicon carbide, gallium nitride based material or diamond.

What is claimed is:

1. An indoor equipment of an air-conditioner, the indoor equipment comprising:

a casing including an inlet and an outlet, the casing including therein, a heat exchanger, an indoor fan which sends indoor air sucked from the inlet to the outlet through the heat exchanger, an indoor fan motor which drives the indoor fan, the indoor fan motor including a rotor of the motor and a stator having an electric winding, and an enclosed electric component box made of a high flame-resistant material which accommodates a circuit board controlling the indoor fan motor, the outer surface of the electric component box having an opening, a connector with high flame resistance is located in the opening, wherein an inverter circuit controlling a current flowing through the stator is mounted on the circuit board which is accommodated in the electric component box, wherein at least one element among switching elements and diode elements which configure the inverter circuit is formed of a wide bandgap semiconductor, and wherein the circuit board is arranged so that a surface of a module of the inverter circuit directly contacts a housing of the electric component box for heat dissipation without fins on the module.

2. The indoor equipment of an air-conditioner according to claim 1, wherein the inverter circuit is mounted on the circuit board semiconductor within the module.

3. The indoor equipment of an air-conditioner according to claim 1, wherein all of the switching elements and diode elements which configure the inverter circuit are formed of a wide bandgap semiconductor.

4. The indoor equipment of an air-conditioner according to claim 1, wherein at least the stator of the indoor fan motor is covered with a mold.

5. The indoor equipment of an air-conditioner according to claim 1, wherein the inverter circuit of the indoor fan motor is driven by sine waves.

6. The indoor equipment of an air-conditioner according to claim 1, wherein the wide bandgap semiconductor is silicon carbide, a gallium nitride based material or diamond.

7. The indoor equipment of an air-conditioner according to claim 1, wherein the electric component box includes a recess, and the indoor fan motor is external to the electric component box and located in the recess.

8. The indoor equipment of an air-conditioner according to claim 1, wherein the connector is directly connected to the circuit board.

9. The indoor equipment of an air-conditioner according to claim 1, wherein one surface of the module is mounted on the circuit board, and an opposite surface of the module contacts the housing.

* * * * *